US008910721B1

(12) United States Patent
Harris et al.

(10) Patent No.: US 8,910,721 B1
(45) Date of Patent: Dec. 16, 2014

(54) METHOD OF USE OF A QUICK CONNECT LINER LATCH SYSTEM FOR USE WITH OIL WELL PRODUCTION LINER INSERTION WITH WIRE LINE

(76) Inventors: Robert Harris, Anchorage, AK (US); Carl Diller, Anchorage, AK (US); Candice English, Anchorage, AK (US)

( * ) Notice: Subject to any disclaimer, the term of this patent is extended or adjusted under 35 U.S.C. 154(b) by 363 days.

(21) Appl. No.: 13/317,974

(22) Filed: Nov. 1, 2011

(51) Int. Cl.
*E21B 43/10* (2006.01)

(52) U.S. Cl.
CPC ..... *E21B 43/10* (2013.01)
USPC ..... 166/382; 166/381; 166/242.6; 166/242.7

(58) Field of Classification Search
CPC ..... E21B 43/10; E21B 17/08
USPC ..... 166/242.6, 242.7, 242.8, 380, 381, 382; 285/330
See application file for complete search history.

(56) References Cited

U.S. PATENT DOCUMENTS 4,830,408 A * 5/1989 Reimert ..... 285/27
7,854,266 B2 * 12/2010 Watson ..... 166/380

* cited by examiner

*Primary Examiner* — Jennifer H Gay
*Assistant Examiner* — George Gray
(74) *Attorney, Agent, or Firm* — Michael J. Tavella

(57) ABSTRACT

A method of use of a quick connect liner latch system assembly (QCLL). The QCLL latches each joint of a slick line deployed liner together quickly. This system can set an anchor in an existing well bore at a shallow depth and run a new liner in the well with a wire line unit using the QCLL system. The QCLL has two main sections that are locked together to form the full QCLL. The upper and lowers sections are locked together using a body lock ring. The units are not threaded together. The QCLL it has a latch with an inside diameter (ID) that is large enough to accommodate a standard liner wiper plug for the weight of the liner being run into the well.

8 Claims, 18 Drawing Sheets

METHOD OF USE OF A QUICK CONNECT LINER LATCH SYSTEM FOR USE WITH OIL WELL PRODUCTION LINER INSERTION WITH WIRE LINE

CROSS REFERENCE TO RELATED APPLICATIONS

Not Applicable

STATEMENT REGARDING FEDERALLY SPONSORED RESEARCH AND DEVELOPMENT

Not Applicable

BACKGROUND OF THE INVENTION

1. Field of the Invention

This invention relates to a method of use for a quick connect liner latch system and particularly methods of use of quick connect liner latch system assemblies for use in oil well production liners.

2. Description of the Prior Art

When remedial work or repair work is needed for damaged or compromised well casing or production tubing, a liner is often used for the repairs. Two specific types of repairs are considered herein. The first is the installation of a scab liner, where the deployed pipe is set on the bottom (plug back total depth (PBTD)); landed on a profile nipple within an existing completion; or hung in tubing or casing with a CT liner hanger. In practice today, a conventional cement job can then be performed to permanently place the new liner in the well.

The second application discussed here is an extended length straddle, where an interval within the well bore (production tubing or casing) requires remediation, repair or production modification, such as a water or gas shut off. This type of repair is normally used for intervals greater than 35 feet in length.

For both of these types of interventions the industry standard uses screw-together pipe. For cemented and un-cemented scab liners the use of a drilling rig, work over rig, or work platform is used to make up and run the liner in a single trip. The "footprint", i.e., support equipment and manpower is typically large. Thus, these types of installations are costly and time consuming.

BRIEF DESCRIPTION OF THE INVENTION

The instant invention overcomes the need for a large "footprint" for making repairs. The invention is part of a "slick line deployed liner" (SLDL), which is a lower cost and a "rig-less" intervention on wells requiring remedial work to repair damaged or compromised casing or production tubing.

The SLDL allows the operator to deploy the liner in the well using a slick line (S/L) unit and lubricator requiring only a three-man crew.

Unlike the screw type liners used in the prior art, this method employs a snap tighter device called the quick connect liner latch system assembly (QCLL). The QCLL is a device that attaches to sections of liner above ground, prior to insertion into the well. This allows workers to easily place the QCLL components onto lengths of liner using simple tools. Once installed, the QCLL components allow each joint of the liner to be snapped together below ground quickly and easily. This system is to able to set an anchor in an existing well bore at a shallow depth and run a new liner in the well with a wire line unit using the QCLL system. It is a safer operation for the men and environment and huge cost savings to the operator.

The QCLL, which is the subject of our copending application entitled "Quick Connect Liner Latch System Assembly Oil Well Production Liner Insertion With Wire Line" and which is incorporated herein by reference, is a device that has two main sections—and upper section and a lower section—that are locked together to form the full QCLL. The upper and lowers sections are locked together using a body lock ring to snap them together. The units are not threaded together, which eliminates the need for a conventional rig for installation. The QCLL is unique because, in the preferred embodiment, the inside diameter (ID) of the latch remains large enough to accommodate a standard liner wiper plug for the weight of the liner being run into the well. To accomplish this, a specially designed running tool was developed. Although there are several snap together latches commercially available, there are none that have an ID that allows the passage of a liner wiper plug system. Although there have been liners latched together before in oil wells, none have been cemented using a standard liner wiper plug system for the pipe size being run. Using the specially designed QCLL system and running procedures, brings a new method of relining old well bores with new pipe that enables the largest ID possible to be maintained for more well intervention work.

Figure 16:
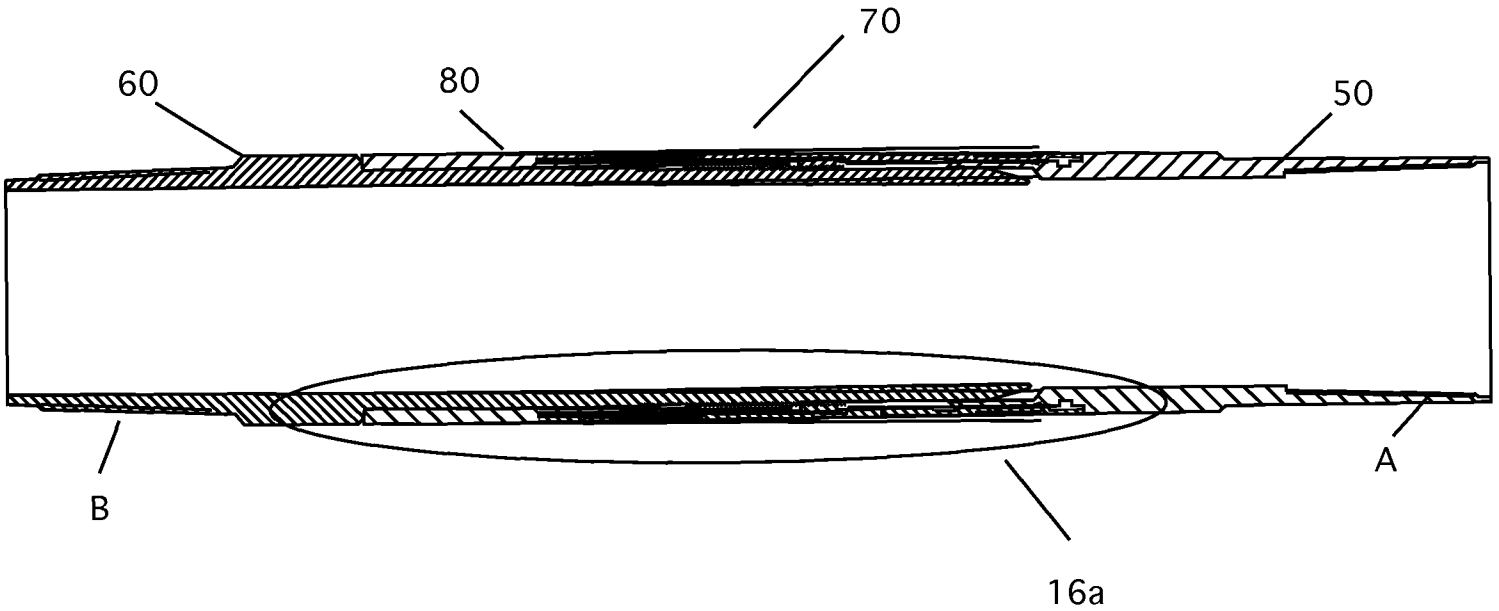
FIG. 16 is a cross-sectional view of the preferred embodiment of the assembled QCLL.

FIG. **16*a* is an enlarged view of the portion of FIG. 16 marked 16*a***.

Figure 17:
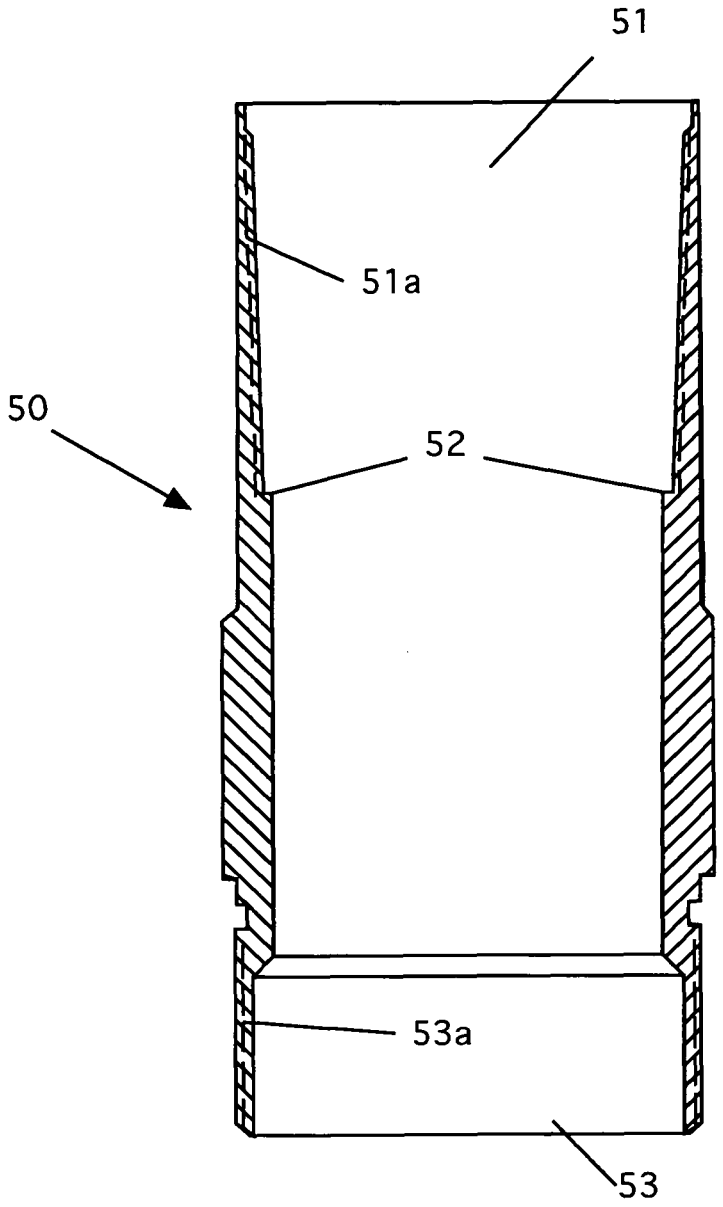

FIG. 17 is an enlarged detail cross-section of the crossover and packing nut portion of preferred embodiment of the QCLL.

Figure 18:
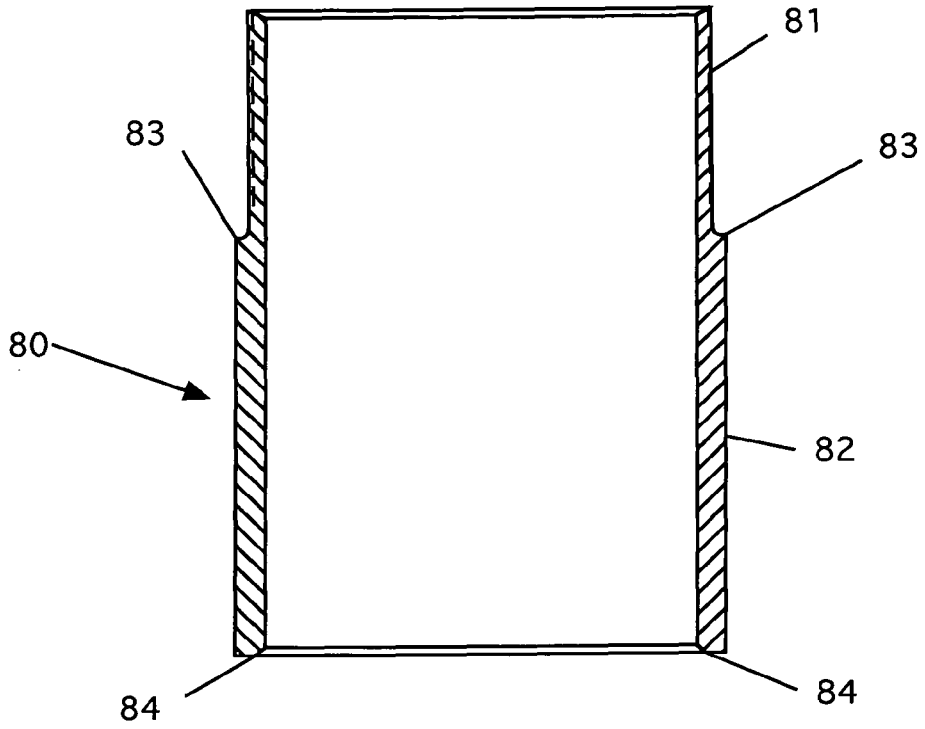

FIG. 18 is an enlarged detail cross-section of the body lock ring retaining nut or guide portion of the preferred embodiment of the QCLL.

Figure 19:
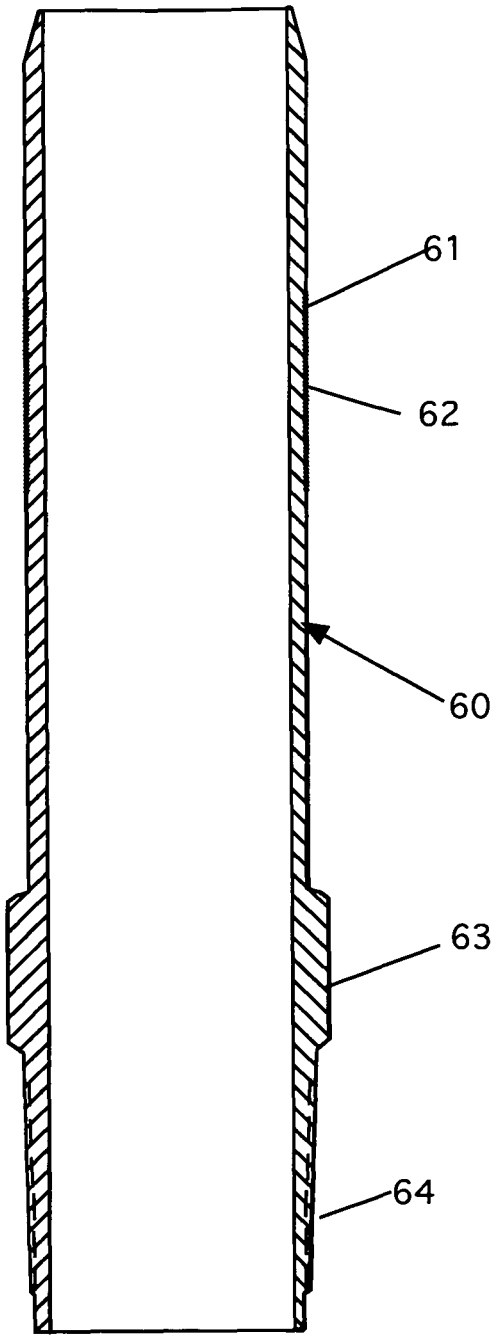

FIG. 19 is an enlarged detail cross-section of the QCLL mandrel portion of the preferred embodiment of the QCLL.

Figure 20:
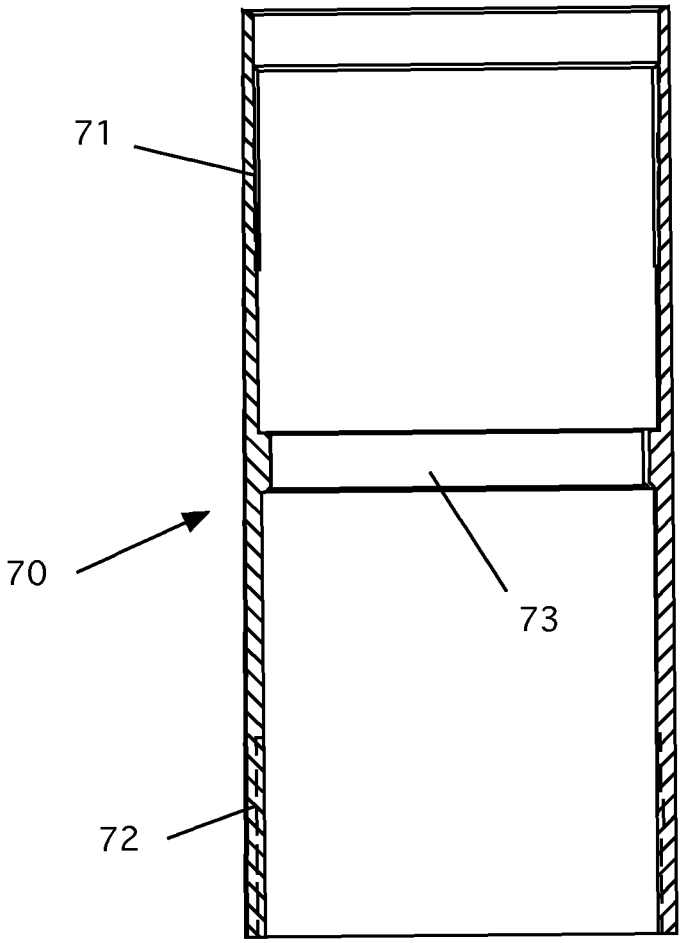

FIG. 20 is an enlarged detail cross-section of the body lock ring and packing housing portion of the preferred embodiment of the QCLL.

Figure 21:
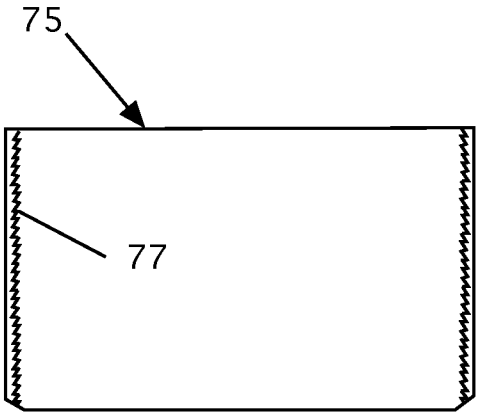

FIG. 21 is an enlarged detail cross-section of body lock ring portion of the preferred embodiment of the QCLL.

DETAILED DESCRIPTION OF THE INVENTION

In the case of a PBTD remediation, prior to picking up any liner a "bottom" must be created in the well. If the PBTD is accessible with a S/L (e.g., for a hole angle less than 70 degrees), the liner can be run in with each modular section snapping into the next until the desired length of liner is in the well. If the PBTD cannot be reached with S/L or if the liner is to be set "off bottom" or "hung", a device is introduced into the well bore prior to picking up the first joint of liner. This device is known as a "retrievable anchor". It is unique in that it acts as a temporary bottom to "land" the modular liner sections on until such time it is ready to be released. Once released, the anchor will collapse to a diameter smaller than the pipe in which it is set. Once the anchor is released, the liner can be conveyed to the desired "setting depth" at PBTD, used as a nipple profile, or hung in a predetermined place in the well.

Once the S/L has placed the desired length of liner in the well, a means to attach to the liner, release the anchor, and place liner at setting depth is needed. To do this, a coil-tubing unit (CTU) is used. Again, in this operation no work platform is needed. Thus, this operation also saves support equipment and uses a smaller footprint.

Because the liner is to be cemented, the conduit used to place the cement is the CTU. The CTU has the capacity to engage the liner, release the anchor, run to depth, release from the liner, and cement it in place. These steps are conducted in a single trip.

Figure 1:
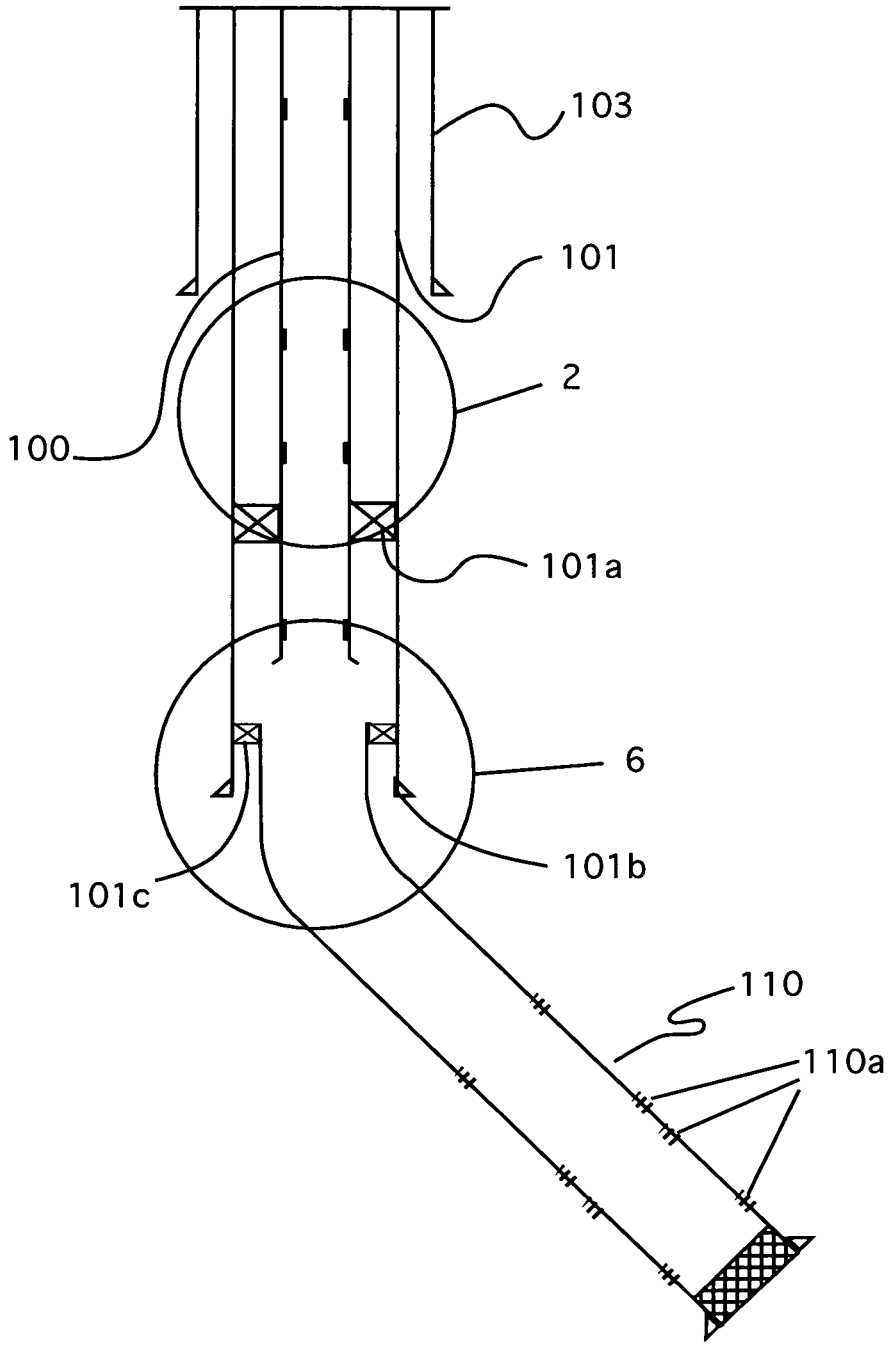
FIG. 1 is a typical well bore diagram used in the oil and gas industry.

The process of the PBTD operation is described below:

FIG. 1 is a typical well bore diagram that should be easily recognized by most in the oil and gas industry. It shows a well with an open hole formation 103 at the top of the well, a 7"×26#6.184" ID casing 101, a 7 inch production packer 101*a*, 4½" 12.6#3.958" ID Production Liner 100. Near the 7-inch casing shoe 101*b* is a 7-inch by 5.5-inch liner hanger 101*c* and a length of 5.5-inch 17#4.892 inch ID production liner 110 with perforations 110*a* as shown.

Figure 2:
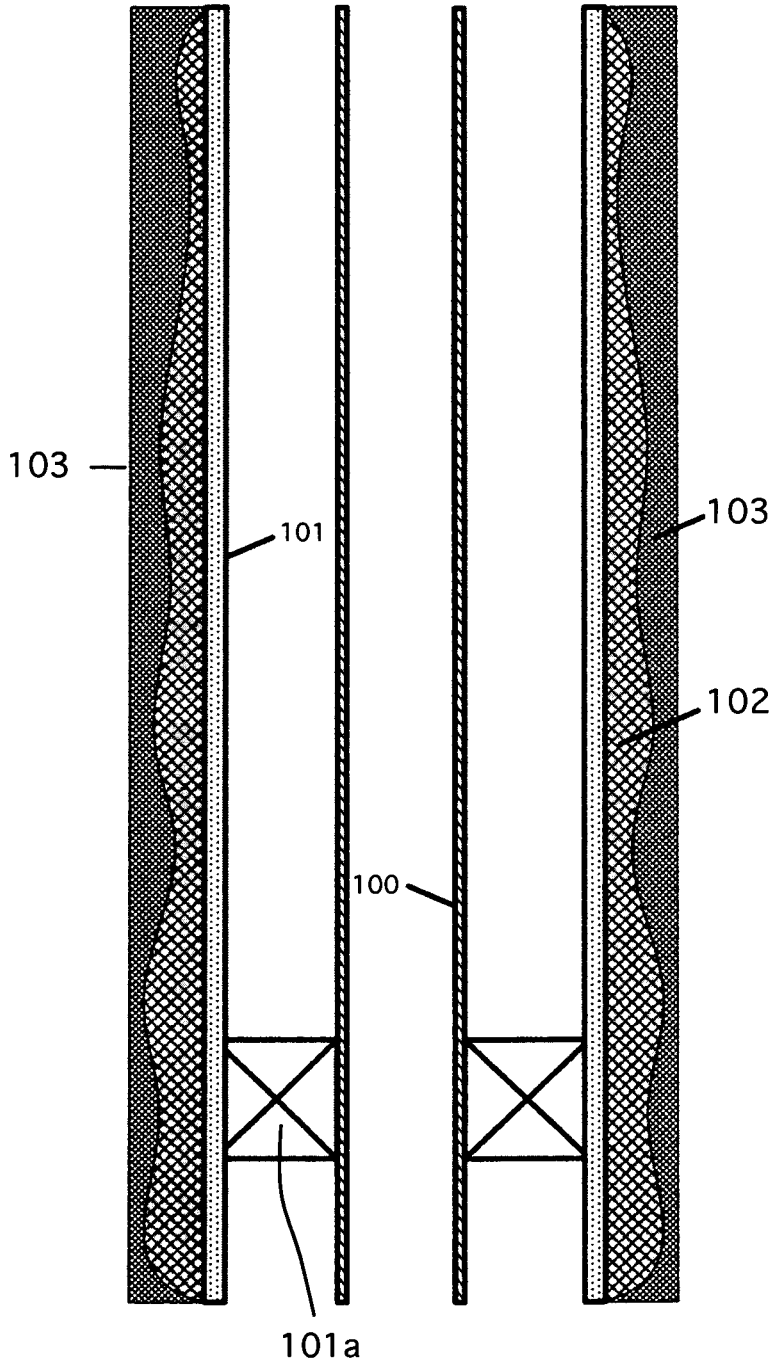
FIG. 2 is an enlarged detail view of a cross-sectional view of a well in the area of the inset of FIG. 1.

FIG. 2 is a detail of a portion of FIG. 1 as identified by the inset 2 on FIG. 1. This figure shows the well structure with the 4½" 12.6#3.958" ID production liner 100, the 7"×26#6.184" ID casing 101, cement 102 holding 7" liner in place and the open hole formation 103. The 7-inch production packer 101*a* is also shown.

Figure 3:
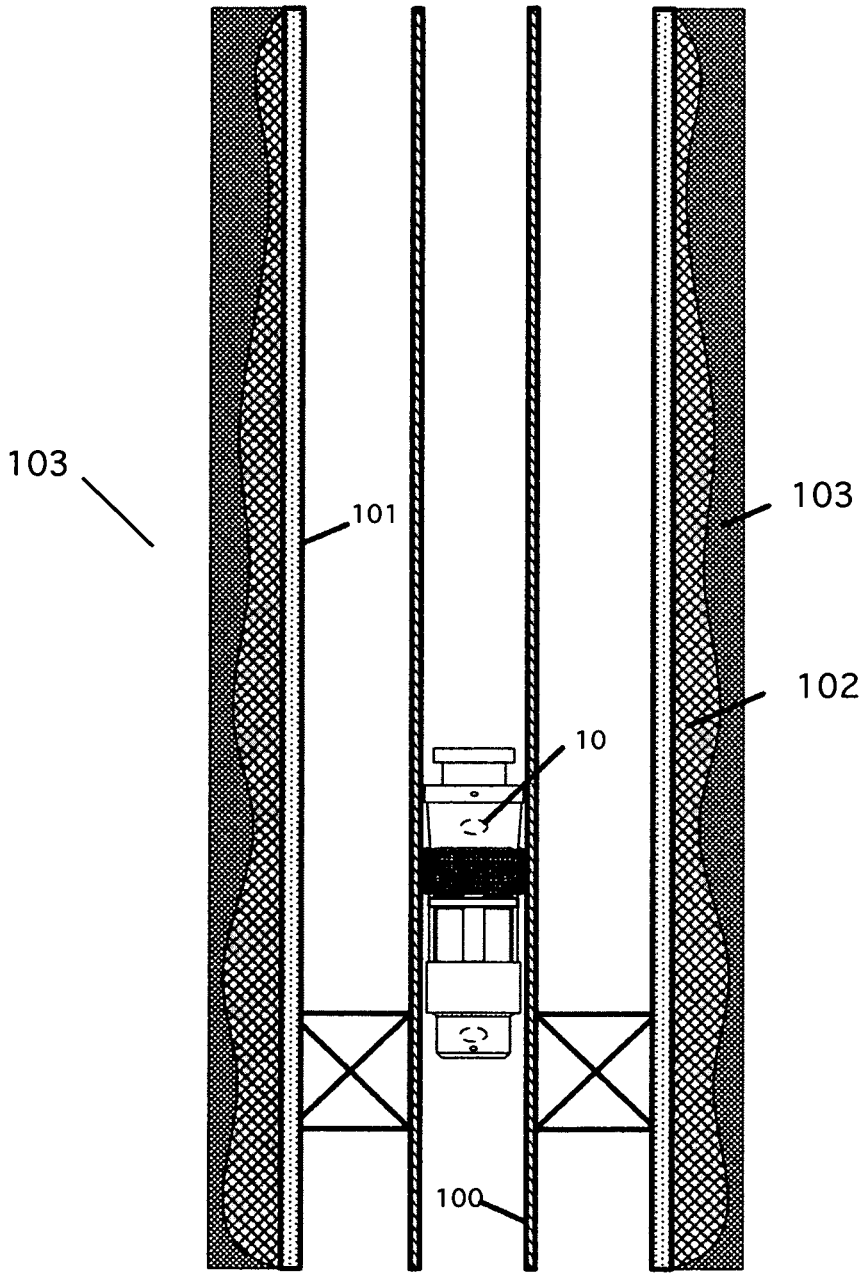
FIG. 3 is cross-sectional view of the well of FIG. 1 showing a pull release tubing stop (PRTS) set inside a 4½" production casing just above the production packer.

FIG. 3 shows the well with a pull release tubing stop (PTRS) 10 set inside the 4½" production casing 100 just above the production packer 101*a*. As shown, the PRTS becomes the bottom or "platform" to assemble the SLDL. The PRTS provides a "bottom" on which to land all subsequent liner components when the PBTD cannot be reached with S/L. It can be set mechanically with slick line or with electric line when depth control is critical.

Figure 4:
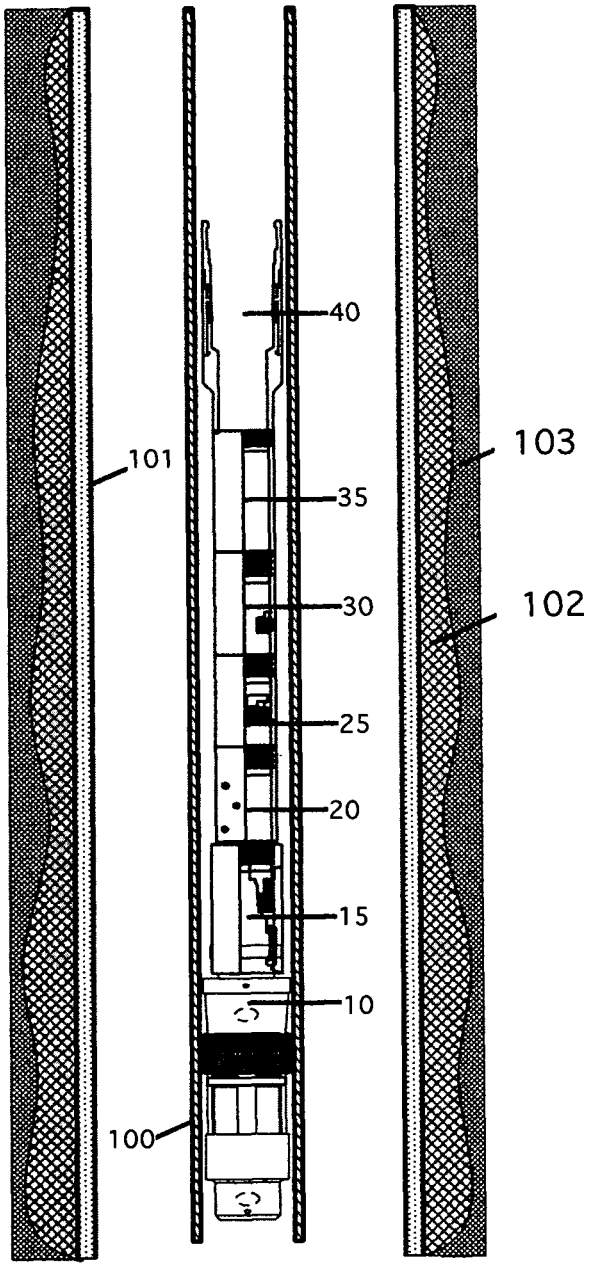
FIG. 4 is a detail cross-section of the well showing a "shoe joint" latched onto the PRTS. The tubing stop over shot is shown fully engaged over the fish neck of the PRTS.

FIG. 4 shows a well with the shoe joint latched onto the PRTS. The shoe joint has a number of components. These are the tubing stop over shot (TSOS), which is fully engaged over the fish neck of the PRTS. The components above the TSOS are a ported sub 20, a float collar 25, a landing collar 30, and a tubing joint 35. All of these components are prior art devices well known in the art. Note that the tubing joint 35 is shown as being a short length. That is for illustration purposes only. Normally tubing joint is a length of pipe about 30 feet long.

At the top end of the tubing joint 25, is a quick connect receptacle. This is one part of the OCLL system and is described in more detail below. All of these components are assembled at surface and run in a single trip. All of these are shown in detail and described below.

Once the TSOS is latched to the PRTS, a slight strain is pulled against the assembly to ensure all components are connected.

A full joint of liner (pipe) is made up of items 10 through 30. It is considered part of the new or repaired well, bored and cemented in place. The first joint in the well is part of the SLDL shoe joint.

Figure 5:
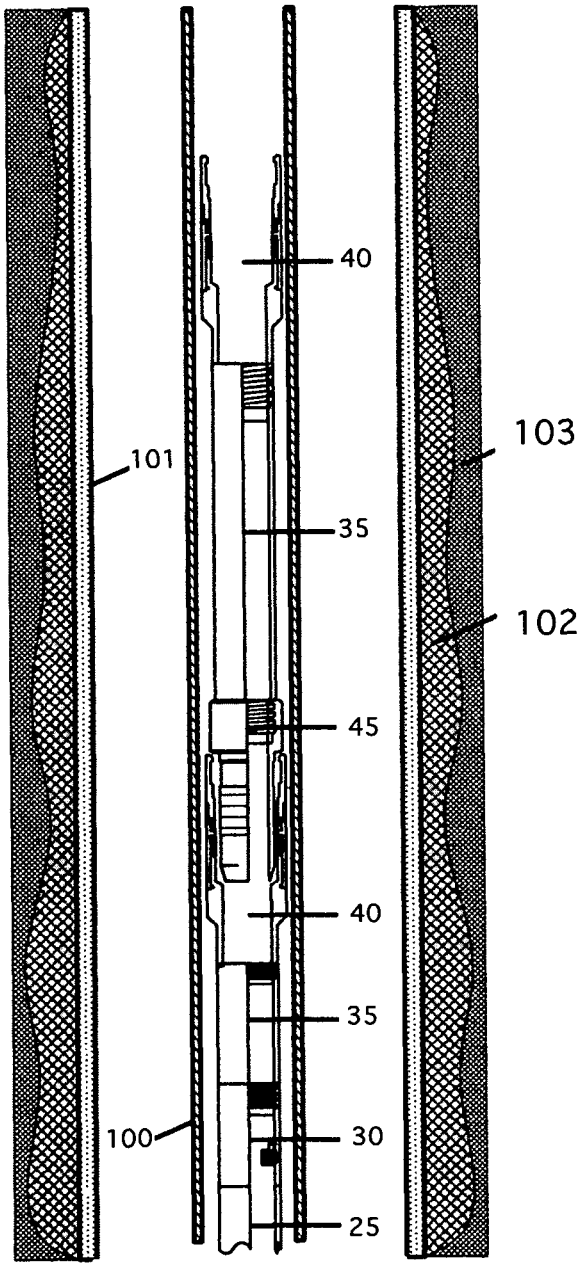
FIG. 5 is a detail view of the well showing the assembly of FIG. 4 ready to receive a section of liner using the interlocking QCLL connection.
Figure 6:
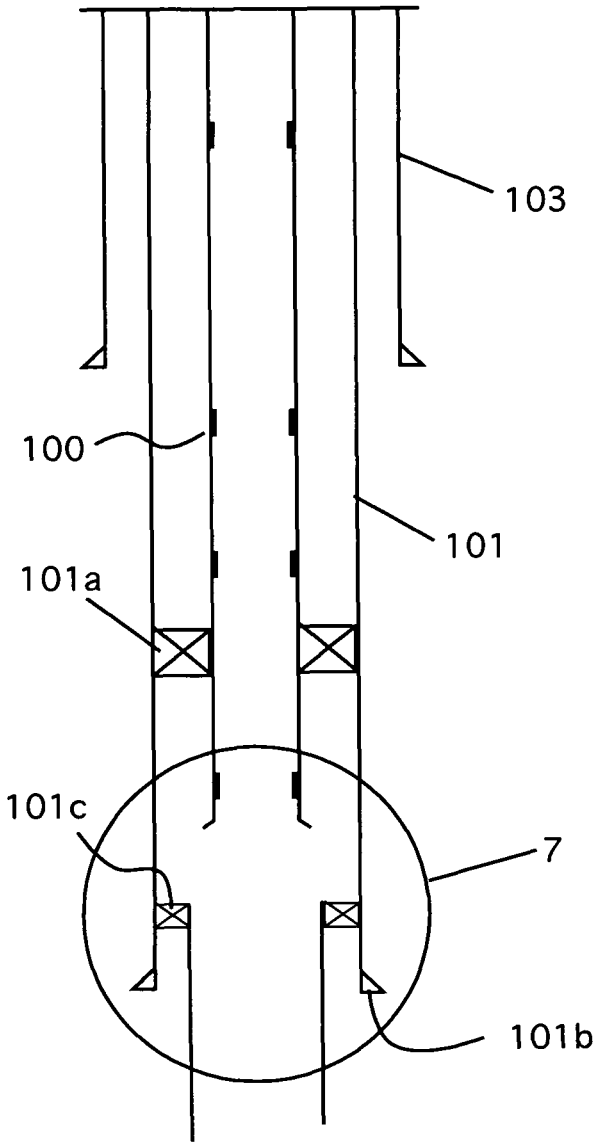
FIG. 6 is an enlarged portion of the well bore diagram of FIG. 1 as labeled "6" on FIG. 1.
Figure 7:
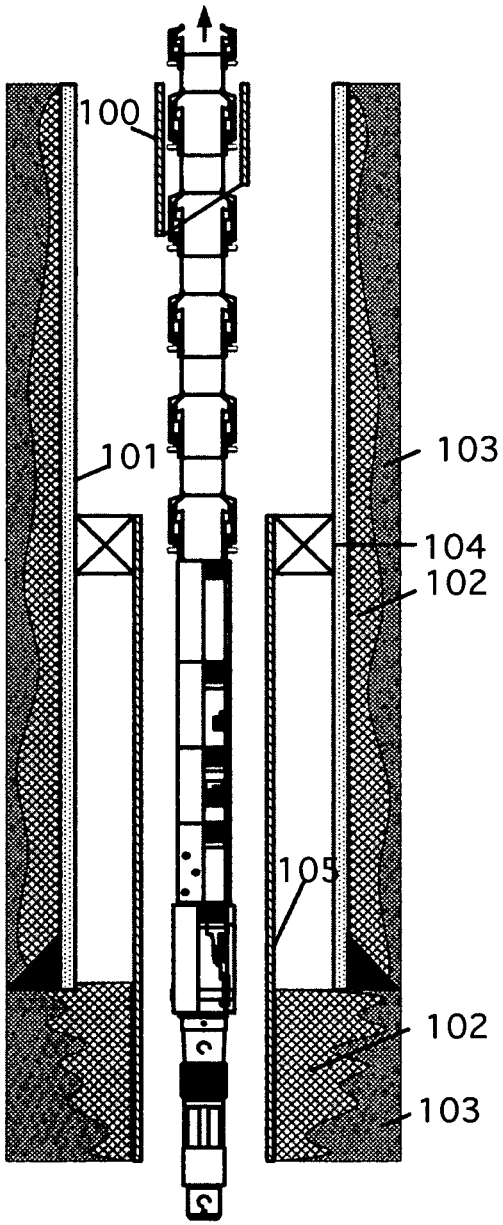
FIG. 7 is an enlarged detail view of a cross-sectional view of a well in the area of the inset of FIG. 6, showing a liner made up using a number of QCLL joints.

FIG. 5 is a detail view of the well showing the assembly of FIG. 4 ready to receive the first full joint being run. Unlike the traditional methods that require a rig to screw the upper liner section into the lower tubing joint, the quick connect system works by installing a "stinger" section 45 on the bottom of the tubing joint 35. The tubing joint with the stinger attached is placed into the well where the stinger then engages the quick connect receptacle 40. As discussed below, the connection is made by pushing, not turning. The stinger section is threaded onto the tubing joint above ground using simple tools prior to insertion into the well. Note that prior to insertion, a second quick connect receptacle 40 is threaded onto the top of the tubing joint 35, as shown. In this manner, the operation continues, adding further sections of line until desired length of liner is run in the well. FIG. 7 is an enlarged detail view of a cross-sectional view of a well in the area of the inset of FIG. 6, showing a liner made up using a number of QCLL joints.

A description of the specific components of the system follows.

Figure 8:
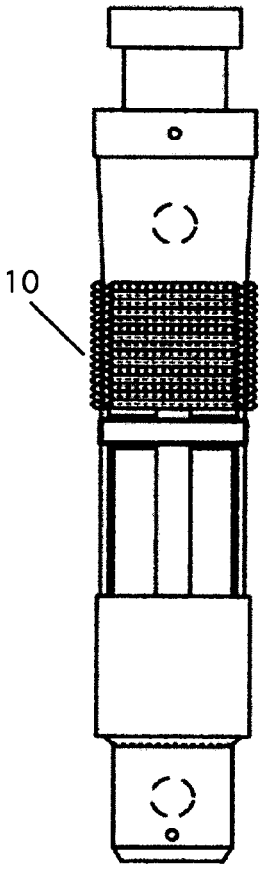
FIG. 8 is a detail of the pull release tubing stop.

FIG. 8 is a detail of the pull release tubing stop as prior art.

The PRTS 10 provides a "bottom" to land all subsequent liner components on when PBTD cannot be reached with S/L. It can be set mechanically with slick line or with electric line when depth control is critical. The PRTS is released with over pull of 2K to 5K at the tool.

Figure 9:
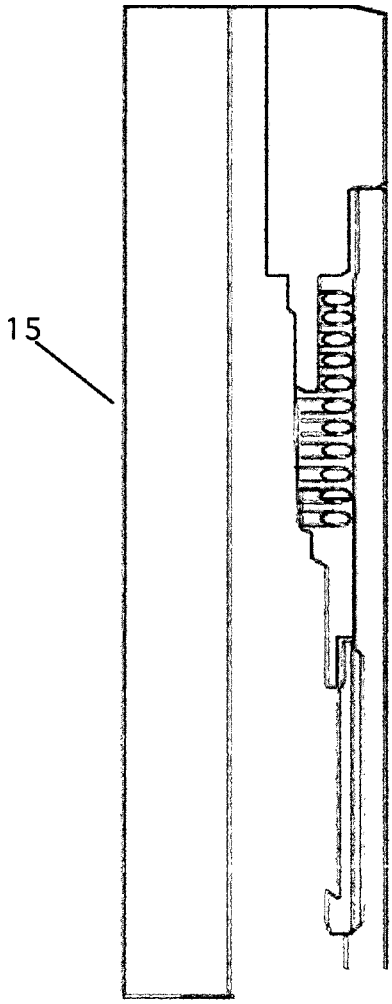
FIG. 9 is a detail of the Tubing stop over shot.

FIG. 9 is a detail of the tubing stop over shot (TSOS) 15. The TSOS is designed to engage the fish neck of the PRTS. It consists of a permanent latch mechanism that is not releasable once attached to the PRTS fish neck. It is part of the SLDL shoe joint.

Figure 10:
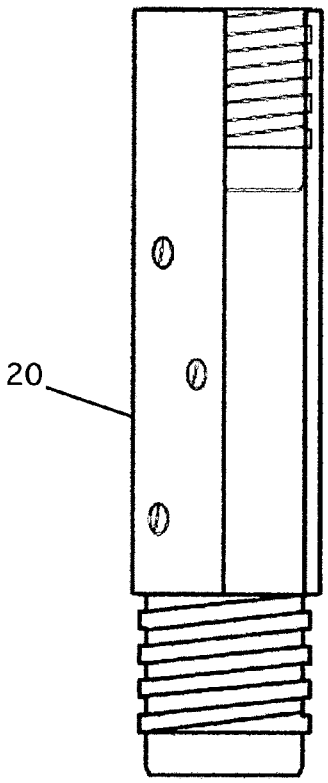
FIG. 10 is a detail of a ported sub.

FIG. 10 is a detail of a ported sub 20. The ported sub provides an unobstructed circulation path for fluids once the SLDL is fully made up and is run into well. The circulation path is above the PRTS so as to minimize the possibility of packing off the ID in the PRTS. It is part of the SLDL shoe joint.

Figure 11:
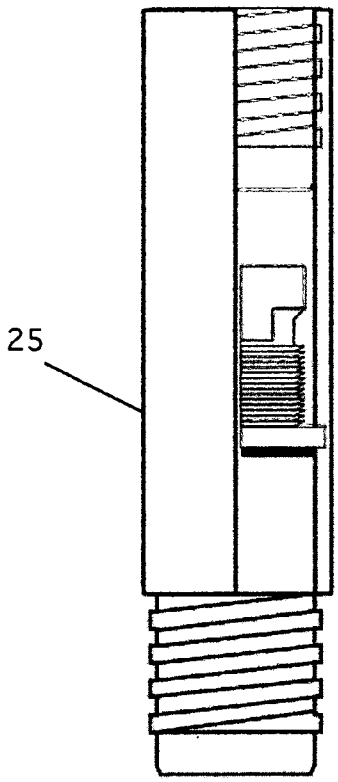
FIG. 11 is a detail of the float collar.

FIG. 11 is a detail of the float collar 25. The float collar is common in the oil and gas industry. It provides a means of retaining cement on the back side of a liner once the cement has been displaced. The float collar can be pumped through and when the pump is stopped, a check-valve assembly in the float collar closes to prevent the backflow of cement or fluid into the liner string. It is part of the SLDL shoe joint.

Figure 12:
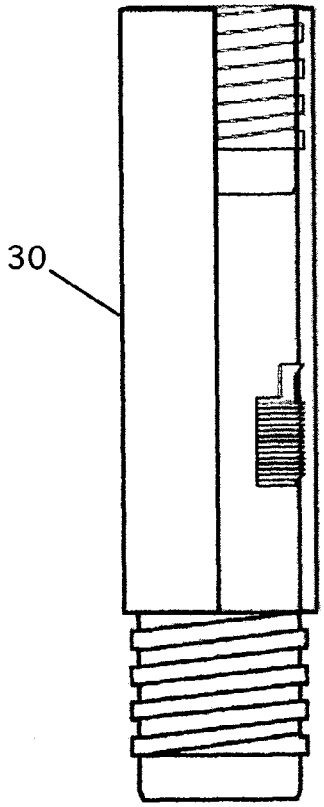
FIG. 12 is a detail of a liner wiper plug landing collar.

FIG. 12 is a detail of a liner wiper plug landing collar 30. The landing collar is another component installed near the bottom of the liner string, which the cement liner wiper plug lands during liner cementing. It is part of the SLDL shoe joint.

Figure 13:
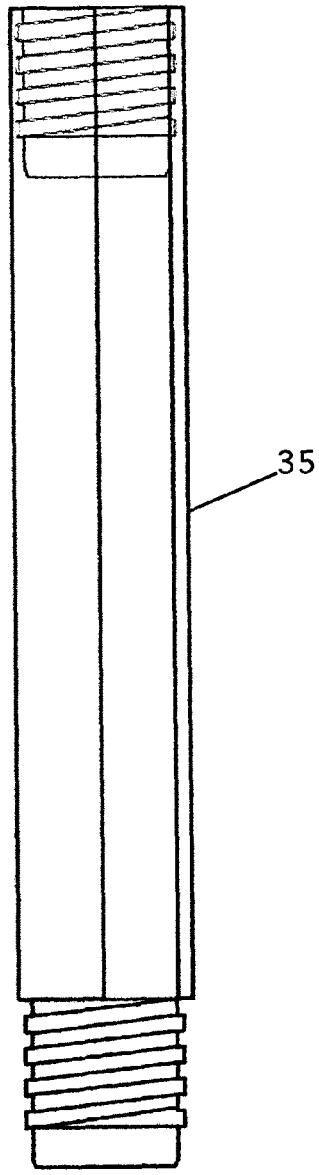
FIG. 13 is a detail of a tubing joint.

FIG. 13 is a detail of a tubing joint 35. The tubing joint is essentially a length of pipe, as discussed above, these pipes are typically approximately 30 feet. They are shown here shortened due to the limitations of drawing size.

In a first embodiment of the QCLL, two components make up the QCCL.

Figure 14:
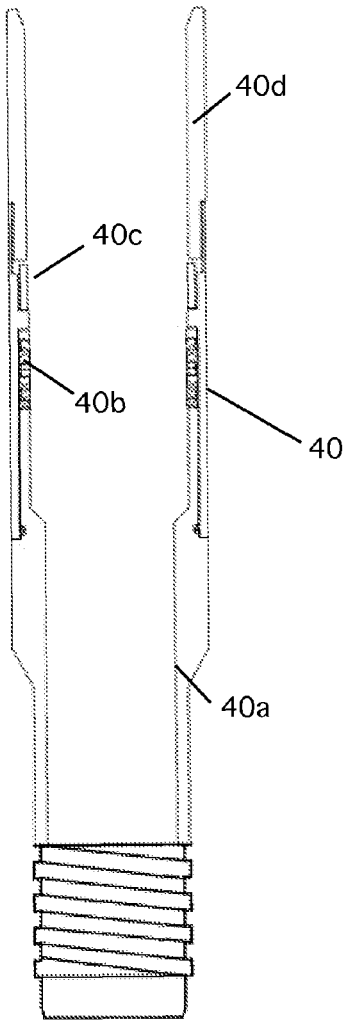
FIG. 14 is a detail of the receptacle portion of a first embodiment of the QCLL.

FIG. 14 is a detail of the receptacle portion 40 (QCR) of the QCLL. In the preferred embodiment, the receptacle portion 40 is comprised of four main parts: a lower body 40*a*, a packing unit 40*b*, a body lock ring 40*c*, and a fishing neck 40*d*. As an assembled single component, the QCR is made up to the top of any given joint from the shoe joint to the upper most joint in the liner. The fishing neck profile allows for common slick line running tools to engage the profile, run in the hole, latch the respective lower component, and release from the assembly.

Figure 15:
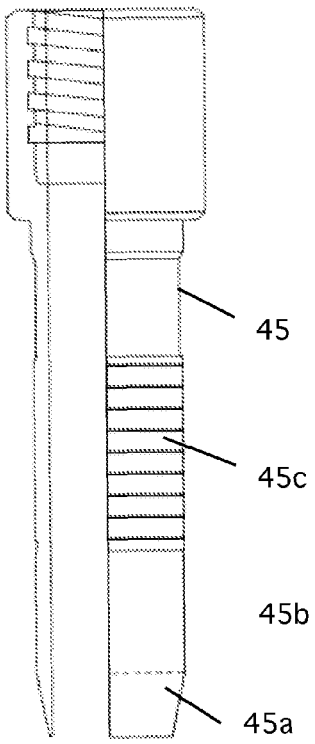
FIG. 15 is a detail of the stinger portion of the first embodiment of the QCLL.

FIG. 15 is a detail of the stinger portion 45 (QCS) of the QCLL. This is the second of the two components that make up the QCLL. As a single component, there are several critical features; The tapered nose 45*a* acts as a guide when inserting into the top of the QCR (i.e., 40*d*), the polished OD 45*b* below the ratchet type threads seal off in the packing ID on the QCR (i.e., 40*b*), the ratchet threads 45*c* engage the body lock ring in the QCR, and the threaded box connection 45*d* will lock when fully inserted into the QCR. The QCS is made up on bottom of the second joint run in the well. The second and all subsequent runs to assemble a SLDL comprise of a quick connect stinger, tubing joint, and quick connect receptacle. Each three-piece component will "snap" into the previously run component.

In the preferred embodiment of the QCLL, the system still has the two main components, but these components have been refined and improved. As discussed above, these two components are the subject of our copending application entitled "Quick Connect Liner Latch System Assembly Oil Well Production Liner Insertion With Wire Line" and which is incorporated herein by reference. That system includes a number of components as described below.

Figure 16A:
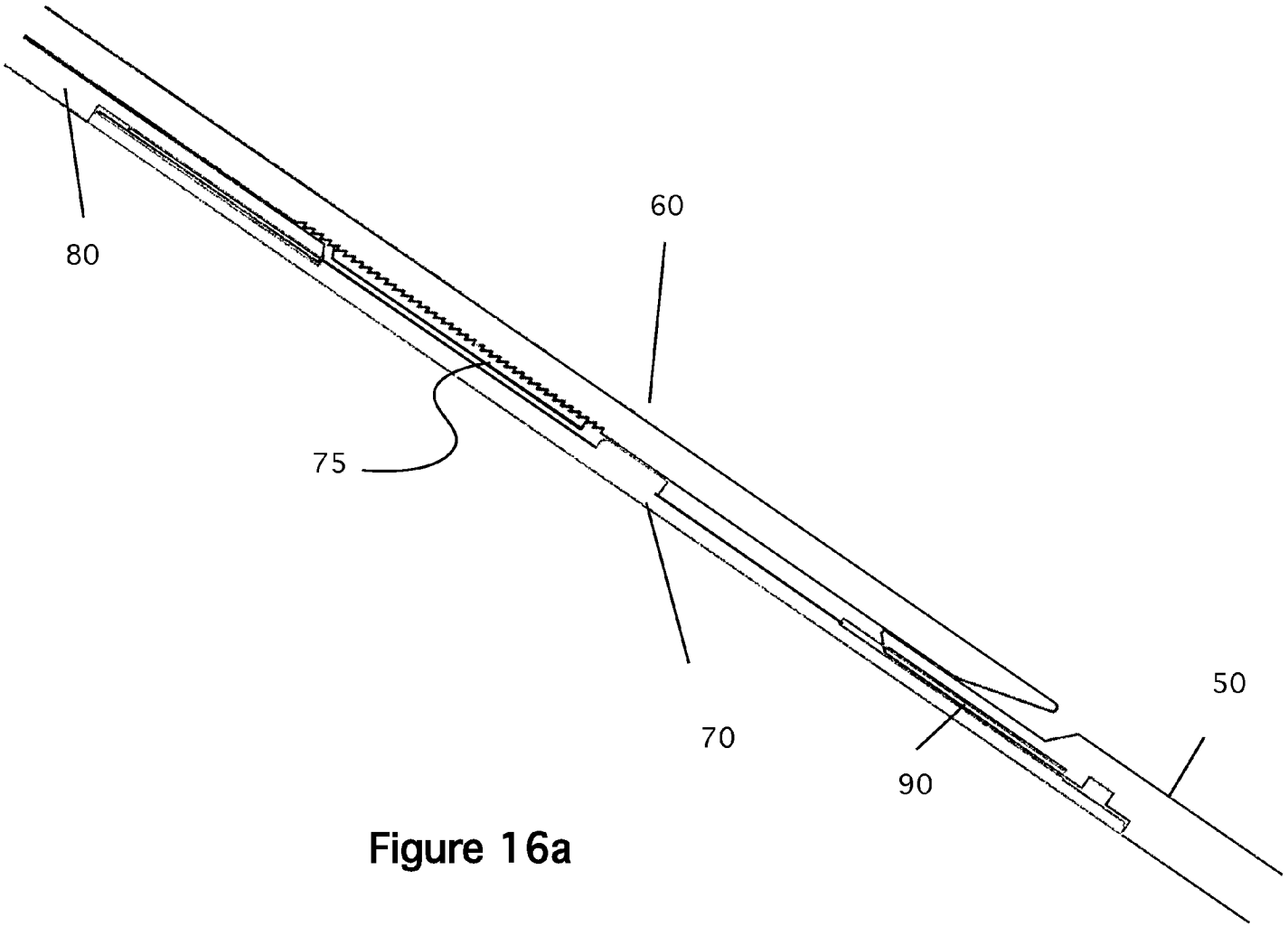

FIG. 16 is a cross-sectional view of the preferred embodiment of an assembled QCLL. Here, all of the components of the QCLL are shown assembled. At the top of the QCLL is a crossover and packing nut assembly 50, which is detailed in FIG. 17. At the bottom of the QCLL is the lower mandrel 60. The lower mandrel is detailed in FIG. 19. The lower mandrel 60 is connected to the crossover and packing nut assembly 50 using a body lock ring (BLR) and packing housing 70. The body lock ring and packing housing 70 is secured using a retaining nut guide 80. A packing unit 90 is also installed in the upper section on the BLR body lock ring and packing housing 70, as shown in FIG. 16*a*. FIG. 16*a* is an enlarged detail of a portion of FIG. 16. This figure shows the area of the figure around the body lock ring and packing housing. The hatching is not shown, for clarity. At the top of the figure is the lower portion of the packing nut assembly 50. The body lock ring and packing housing 70 is also shown. The upper portion of the lower mandrel 60 is at the lower portion of the figure. A portion of the retaining nut guide 80 is also shown, as indicated. The body lock ring 75 is also shown in place as well as the packing 90.

FIG. 17 is an enlarged detail cross-section of the crossover and packing nut portion of the preferred embodiment of the QCLL. In this figure, the crossover and packing nut assembly 50 is shown. At the top is a tapered opening 51 that receives a liner section. This section is threaded with threads 51*a* that attach to the liner (tubing joint 35). The interior of the crossover and packing nut assembly 50 has a ledge 52 onto which the tubing joint seats. At the other end of the crossover and packing nut assembly 50 is an opening 53 that accepts the upper section of the mandrel 60. This opening is also threaded with threads 53*a*. The threads 53*a* make up to the box end of the BLR and packing housing 70 as discussed below.

FIG. 18 is an enlarged detail cross-section of the body lock ring retaining nut portion 80 of the preferred embodiment of the QCLL. This piece is also known as a "Guide". The retaining nut 80 has an upper threaded portion 81 and a lower shoulder portion 84. This nut 80 is screwed onto the bottom of the body lock ring and packing housing 70 (see FIG. 20) until the upper shoulders 83 contact the bottom of the body lock ring and packing housing 70, as discussed below. The retaining nut 80 also acts as a spacer in that, when the lower mandrel 60 is snapped into the body lock ring, it slides down until the shoulder portion of the lower mandrel (see FIG. 19) contacts the bottom edge 84 of the retainer nut 80.

FIG. 19 is an enlarged detail cross-section of the QCLL mandrel portion of the preferred embodiment of the QCLL. The mandrel 60 forms the lower portion of the QCLL. It has a long sidewall that is threaded at 61 with directional threads 62. The mandrel also has a lower up-set 63 and a bottom-threaded portion 64. The lower threaded portion 64 is used to join the lower mandrel to a lower section of tubing joint. The up-set 63 is used as a stop that contacts the retainer nut, as discussed above. The directional threads 62 are used to attach the body lock ring 80.

FIG. 20 is an enlarged detail cross-section of the body lock ring and packing housing portion 70 of the preferred embodiment of the QCLL. The body lock ring and packing housing 70 is the member that houses the components that lock the upper portion and the lower portion of the QCLL. The body lock ring and packing housing has an upper portion 71 and a lower portion 72. It is sized to accept the packing 90 (see, FIG. 16*a*) (installed in portion 71) and body lock ring 75 (see FIG. 21) (installed in portion 72). The packing is installed in portion 71 and held in place with the top sub crossover-packing nut 50 while the BLR 75 is installed in portion 72 and held in place with the retaining nut or guide/guide shoe 80. The center recess portion 73 is used as a stop. It supports the body lock ring to connect the upper and lower portions of the QCLL.

FIG. 21 is an enlarged detail cross-section of body lock ring portion of the preferred embodiment of the QCLL. The body lock ring 75 is a short-bodied cylinder that has a set of directional inner threads 77 that engage the directional threads on the lower mandrel 60.

Once the system is assembled into the two assemblies, the operation is exactly as in the case of the first embodiment. The mandrel is attached to the top of a length of tubing joint. The body lock ring and packing housing portion 70 is attached to the bottom of the next length of tubing joint. When that length of tubing joint is inserted into the well, the threads on the body lock ring engage the threads on the lower mandrel, which locks the two assemblies together. The major advantage of this embodiment over the first embodiment is that, when connected, the QCLL has the same I.D. as the tubing liner (see, FIG. 16). This is clear from the figure. Note that length of tubing liner is threaded at points "A" and "B" on FIG. 16. Thus, the I.D. of the assembly is identical to that of two lengths of tubing joint that are screwed together. The advantage of this system, as noted above, it that the QCLL components can be installed on the tubing liner before it is inserted into the well.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

We claim:

1. A method of use of a plurality of quick connect liner latch systems, each of said plurality of quick connect liner latch systems having a stinger portion, a receptacle portion having a means for locking said receptacle portion to said stinger portion, and a means for locking said stinger portion to said receptacle portion, comprising the steps of:

a) installing a pull release tubing stop in a length of production tubing in a well;

b) forming a shoe joint for insertion into said well, the step of forming a shoe joint including the steps of:

i) installing a first tubing joint onto said shoe joint; and ii) installing one of said receptacle portions of one of said plurality of quick connect liner latch systems on said first tubing joint;

c) placing the shoe joint into the well and securing said shoe joint to said pull release tubing stop;

d) installing the stinger portion of the one of said plurality of quick connect liner latch systems to a bottom end of a second length of tubing joint;

e) installing another receptacle portion of another of said plurality of quick connect liner latch systems to a top end of the second length of tubing joint;

f) placing the second length of tubing joint into the well such that the stinger portion of the one of the plurality of the quick connect liner latch systems enters the well first;

g) pressing the stinger portion of the one of the plurality of the quick connect liner latch systems into the receptacle portion of one of the plurality of quick connect liner latch systems in said first tubing joint; and h) repeating steps d-g until a desired length of liner is reached.

2. The method of claim 1 wherein the shoe joint comprises:

a) a tubing stop over shot;

b) a ported sub, attached to said tubing stop over shot;

c) a float collar attached to said ported sub; and d) a landing collar attached to said float collar.

3. A method of use of a quick connect liner latch system having a crossover and packing nut, having a top and a bottom and interior; a lower mandrel having a set of ratchet threads formed thereon; and a body lock ring having a set of ratchet threads formed thereon, and a means for securing the body lock ring in the crossover and packing nut, comprising the steps of:

a) installing a pull release tubing stop in a length of production tubing in a well;

b) forming a shoe joint for insertion into a well, the step of forming a shoe joint including the steps of:

i) installing a first tubing joint onto said shoe joint; and ii) installing the lower mandrel portion of a quick connect liner latch system to said first tubing joint;

c) placing the shoe joint into the well and securing said shoe joint to said pull release tubing stop;

d) installing the crossover and packing nut, and body lock ring to a bottom end of a second length of tubing joint;

e) installing a lower mandrel portion of a quick connect liner latch system to a top end of the second length of tubing joint;

f) placing the second length of tubing joint into the well such that the crossover and packing nut engages the lower mandrel;

g) pressing the crossover and packing nut of the quick connect liner latch system onto the lower mandrel portion of the quick connect liner latch system until the ratchet threads on the lower mandrel engage the ratchet threads on the body lock ring in said first tubing joint; and h) repeating steps d-g until a desired length of liner is reached.

4. The method of claim 3 wherein the means for securing the body lock ring in the crossover and packing nut comprise a retaining nut, attached to said crossover and packing nut.

5. The method of claim 3 wherein the lower mandrel and crossover and packing nut further comprise a means for threadably securing the lower mandrel and crossover packing nut to a length of tubing joint.

6. The method of claim 3 wherein the crossover and packing nut further comprise a seal installed in said crossover and packing nut.

7. The method of claim 3 wherein the top of said crossover and packing nut is fitted with a set of threads.

8. The method of claim 3 wherein the bottom of said lower mandrel is fitted with a set of threads.

* * * * *